US012098860B2

(12) United States Patent
Reardon et al.

(10) Patent No.: US 12,098,860 B2
(45) Date of Patent: Sep. 24, 2024

(54) ELECTRIC HEATER PACKAGE FOR HVAC UNIT

(71) Applicant: Johnson Controls Technology Company, Auburn Hills, MI (US)

(72) Inventors: Anthony J. Reardon, Moore, OK (US); Praveen M. Gotakhindi, Pune (IN); Sriram Ramanujam, Pune (IN); Karan Garg, Pune (IN)

(73) Assignee: Tyco Fire & Security GmbH, Schaffhausen (CH)

( * ) Notice: Subject to any disclaimer, the term of this patent is extended or adjusted under 35 U.S.C. 154(b) by 1582 days.

(21) Appl. No.: 16/366,164

(22) Filed: Mar. 27, 2019

(65) Prior Publication Data

US 2020/0309402 A1 Oct. 1, 2020

Related U.S. Application Data

(60) Provisional application No. 62/823,201, filed on Mar. 25, 2019.

(51) Int. Cl.
*F24F 11/871* (2018.01)
*F24F 1/0093* (2019.01)
(Continued)

(52) U.S. Cl.
CPC ..... *F24F 11/871* (2018.01); *F24F 1/0093* (2019.02); *F24F 1/0375* (2019.02);
(Continued)

(58) Field of Classification Search
CPC .... F24F 1/0093; F24F 1/0375; F24F 2221/16; F24F 2221/34; F24F 2221/54; F24F 1/0047; F24F 7/025
See application file for complete search history.

(56) References Cited

U.S. PATENT DOCUMENTS 4,169,500 A * 10/1979 Braver ..... F24F 1/0057 165/76
4,841,733 A * 6/1989 Dussault ..... F24F 12/001 165/223
(Continued)

FOREIGN PATENT DOCUMENTS

JP H05118578 A * 5/1993
JP 2000039169 A * 2/2000 ..... F24F 1/005
(Continued)

OTHER PUBLICATIONS

Translated_Park (Year: 2001).*
(Continued)

*Primary Examiner* — Elizabeth J Martin
*Assistant Examiner* — Samba Gaye
(74) *Attorney, Agent, or Firm* — Fletcher Yoder, PC

(57) ABSTRACT

A heating, ventilation, and/or air conditioning (HVAC) unit includes a heater housing having a first side wall, a second side wall opposing the first side wall, and a ceiling extending between the first side wall and second side wall. The HVAC unit also includes a first mounting rail disposed across the first side wall at a first distance from the ceiling, and a second mounting rail disposed across the second side wall at a second distance from the ceiling. The first distance is greater than the second distance. The HVAC unit also includes a heating element assembly coupled to the first and second mounting rails and having a planar heating interface extending from the first mounting rail to the second mounting rail.

24 Claims, 9 Drawing Sheets

(51) Int. Cl.
*F24F 1/0375* (2019.01)
*F24F 11/88* (2018.01)

(52) U.S. Cl.
CPC ..... *F24F 11/88* (2018.01); *F24F 2221/16* (2013.01); *F24F 2221/34* (2013.01)

(56) References Cited

U.S. PATENT DOCUMENTS

| | | | | |
|---|---|---|---|---|
| 4,911,234 | A * | 3/1990 | Heberer | F24F 1/56 165/125 |
| 6,370,899 | B1 | 4/2002 | Hobbs et al. | |
| 6,651,037 | B1 | 11/2003 | Hall et al. | |
| 7,206,724 | B2 | 4/2007 | Chen | |
| 7,255,532 | B2 | 8/2007 | Zheng | |
| 7,558,649 | B1 | 7/2009 | Sharma et al. | |
| 8,056,352 | B2 * | 11/2011 | Kang | F04D 25/064 62/298 |
| 9,740,801 | B2 | 8/2017 | Singh et al. | |
| 2005/0034472 | A1 * | 2/2005 | Hong | F24F 3/153 62/298 |
| 2005/0109053 | A1 * | 5/2005 | Eom | F24F 13/222 62/286 |
| 2011/0011112 | A1 * | 1/2011 | Goel | F24F 8/22 29/890.03 |
| 2012/0072181 | A1 | 3/2012 | Imani | |
| 2013/0035794 | A1 | 2/2013 | Imani | |
| 2014/0041401 | A1 * | 2/2014 | Douglas | F24F 11/30 62/89 |
| 2015/0134123 | A1 | 5/2015 | Obinelo | |
| 2018/0292105 | A1 | 10/2018 | Balakrishna et al. | |
| 2019/0195516 | A1 * | 6/2019 | Xue | F24F 1/16 |
| 2020/0025395 | A1 * | 1/2020 | Zhou | F24F 13/20 |

FOREIGN PATENT DOCUMENTS

| | | | |
|---|---|---|---|
| KR | 20000003899 U | * | 2/2000 |
| KR | 2001104978 A | * | 11/2001 |
| KR | 2002043313 A | * | 6/2002 |
| KR | 1006247371 B1 | * | 9/2006 |

OTHER PUBLICATIONS

Translated_Yang (Year: 2006).*
Translated_Motoi (Year: 1993).*
Translated_Cho (Year: 2000).*
Translated_HEO (Year: 2000).*
Translated_Won (Year: 2006).*

* cited by examiner

ELECTRIC HEATER PACKAGE FOR HVAC UNIT

CROSS REFERENCE TO RELATED APPLICATIONS

This application claims priority from and the benefit of U.S. Provisional Application Ser. No. 62/823,201, entitled "ELECTRIC HEATER PACKAGE FOR HVAC UNIT," filed Mar. 25, 2019, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. The HVAC system may control the environmental properties through the control of an airflow delivered to the conditioned environment. For example, a rooftop unit (RTU) of an HVAC system may include a heater, such as an electric heater, configured to heat an airflow delivered to the conditioned environment. In traditional embodiments, certain traditional heaters may be incompatible with the RTU based on a discharge configuration of the RTU. Facilitating compatibility between traditional heaters and RTUs having various discharge configurations may increase a part cost, and may cause expensive and complicated installation processes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

The present disclosure relates to a heating, ventilation, and/or air conditioning (HVAC) unit. The HVAC unit includes a heater housing having a first side wall, a second side wall opposing the first side wall, and a ceiling extending between the first side wall and second side wall. The HVAC unit also includes a first mounting rail disposed across the first side wall at a first distance from the ceiling, and a second mounting rail disposed across the second side wall at a second distance from the ceiling. The first distance is greater than the second distance. The HVAC unit also includes a heating element assembly coupled to the first and second mounting rails and having a planar heating interface extending from the first mounting rail to the second mounting rail.

The present disclosure also relates to a heating, ventilation, and/or air conditioning (HVAC) unit. The HVAC unit includes an electric heater housing having a side wall, an opposing side wall, and a ceiling extending between the side wall and the opposing side wall. The HVAC unit also includes an electric heater disposed in the electric heater housing and having a planar heating interface formed by a heating element of the electric heater, wherein the planar heating interface extends between the side wall and the opposing side wall and forms an oblique angle relative to the side wall.

The present disclosure also relates to an electric heater for a heating, ventilation, and/or air conditioning (HVAC) unit. The electric heater includes a first mounting rail configured to be mounted on a first side wall of an electric heater housing of the HVAC unit, and a second mounting rail configured to be mounted on a second side wall of the electric heater housing. The electric heater also includes a heating element assembly coupled to the first mounting rail and the second mounting rail and having a planar heating interface formed by a heating element of the heating element assembly, wherein the planar heating interface is configured to form an oblique angle with the first side wall and the second side wall of the HVAC unit.

DETAILED DESCRIPTION

Figure 1:
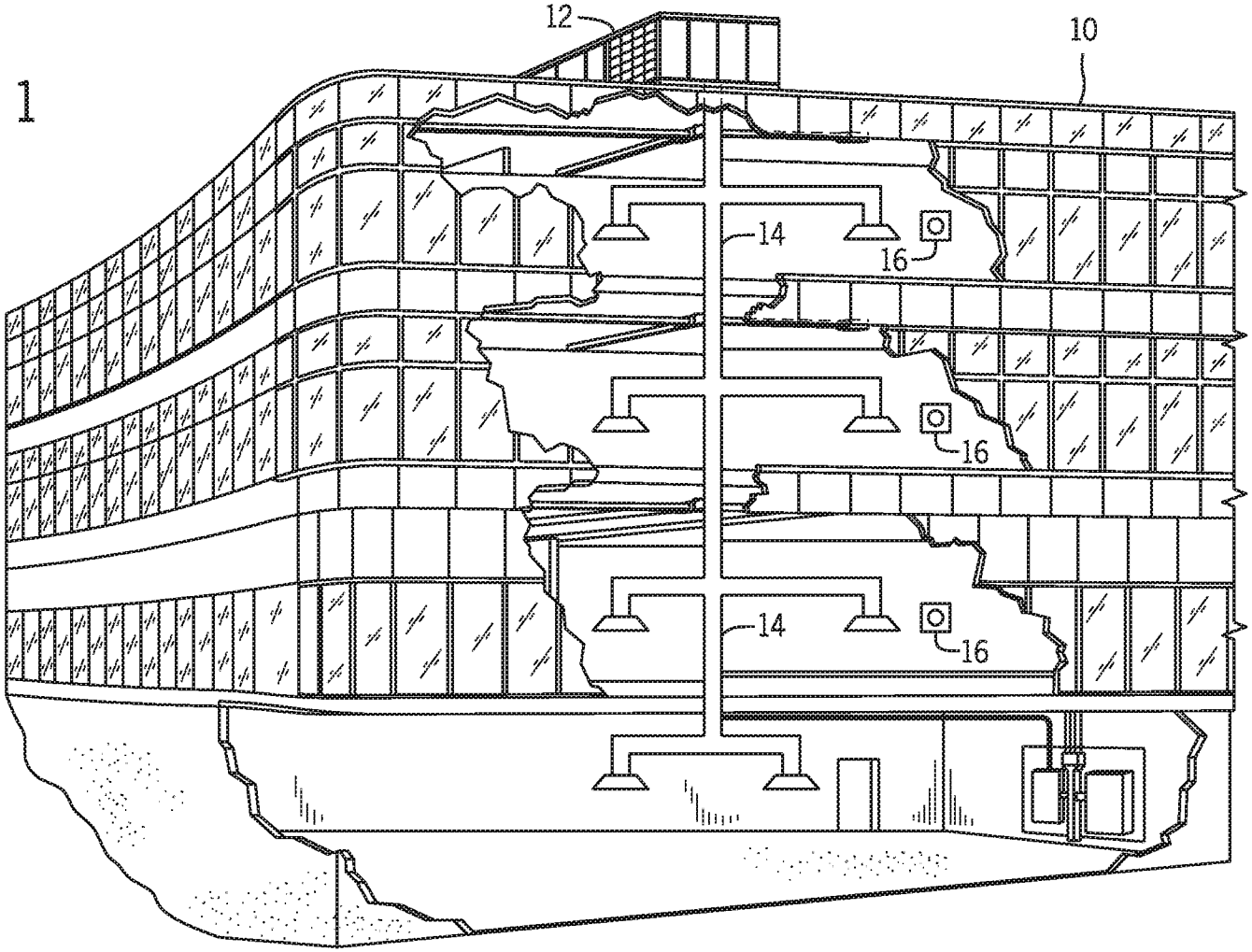
FIG. 1 is a schematic of an embodiment of an HVAC system for building environmental management that includes an HVAC unit, in accordance with an aspect of the present disclosure.

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments.

The present disclosure is directed toward a heater of a unit, such as a rooftop unit (RTU), of a heating, ventilation, and/or air conditioning (HVAC) system. As mentioned above, HVAC systems are utilized in residential, commercial, and industrial environments to control environmental properties, such as temperature and humidity, for occupants of the respective environments. The HVAC system may control the environmental properties through the control of an airflow delivered to the conditioned environment. For example, an RTU of the HVAC system may include a heater configured to heat an airflow delivered to the conditioned environment. Facilitating compatibility between traditional heaters and HVAC units having various discharge configurations may increase a part cost, and may cause expensive and complicated installation processes.

For example, HVAC units, such as RTUs, may be configured for bottom discharge, whereby a duct receives a conditioned airflow, such as a heated airflow, from the HVAC unit through a bottom air output opening of the HVAC unit, or for side discharge, whereby the duct receives the conditioned airflow, such as the heated airflow, through a side air output opening of the HVAC unit. The bottom air output opening may refer to, for example, an opening formed in a bottom of the HVAC unit extending substantially perpendicular to gravity, whereas the side air output opening may refer to, for example, an opening formed in a side wall of the HVAC unit extending substantially parallel to gravity. In traditional embodiments, separate traditional heaters may be employed for bottom discharge unit configurations and for side discharge unit configurations. That is, for a bottom discharge HVAC unit, a first traditional heater may be installed in a heater housing of the HVAC unit, and for a side discharge HVAC unit, a second traditional heater different than the first traditional heater may be installed in the heater housing of the HVAC unit. The first traditional heater, configured for bottom discharge, may be incompatible with HVAC units configured for side discharge, and the second traditional heater, configured for side discharge, may be incompatible with HVAC units configured for bottom discharge. Alternatively, the first traditional heater, configured for bottom discharge, may operate at substantially reduced efficiency if installed in an HVAC unit configured for side discharge, and the second traditional heater, configured for side discharge, may operate at significantly reduced efficiency when installed in an HVAC unit configured for bottom discharge.

In accordance with the present disclosure, a heater may be configured for compatibility with both a bottom discharge HVAC unit and a side discharge HVAC unit. For example, the HVAC unit may include an air input opening, or multiple air input openings, to the heater housing of the HVAC unit. The air input openings may be formed, for example, in a side wall of the heater housing, whether the HVAC unit is configured for bottom discharge or side discharge. Blowers of the HVAC unit, which may correspond in number to the air input openings, may be disposed outside of the heater housing and may be configured to blow or induce airflows through the air input openings in the side wall of the heater housing. The heater, which is disposed within the heater housing of the HVAC unit, may include heating elements configured to receive the airflows passing through the air input openings from the blowers. The heating elements may correspond in number to the air input openings and the blowers. In accordance with present embodiments, the heating elements may form a planar heating interface extending at an oblique angle relative to the side wall having the air input openings, and relative to a direction of the airflows received from the air input openings. For example, in one embodiment, the planar heating interface may extend at a 45 degree angle relative to the side wall in which the air input openings are formed. The angle of the planar heating interface may be within a range of 20-70 degrees relative to the side wall. As used herein, the term "planar" refers to a geometry that is generally flat without pronounced bends, curves, or other undulations, but also not necessarily constrained by a mathematical or Euclidean plane.

The airflows may pass over the planar heating interface, through the heating elements, and into a hot air cavity of the heater housing of the HVAC unit. The hot air received in the hot air cavity of the heater housing may be guided through a bottom discharge air output opening or a side discharge air output opening, depending on whether the HVAC unit is configured for bottom discharge or for side discharge. Further, the heater may include a mounting rail assembly configured to install the heater in the heater housing of the HVAC unit at the above-described angle. For example, the heater housing includes the side wall having the air input openings formed therein and an opposing side wall. The heater is configured to be installed between the side wall and the opposing side wall. A ceiling of the heater housing may extend between the side wall and the opposing side wall, and over the heater. A first mounting rail of the heater may be disposed along the side wall at a first distance from the ceiling, and a second mounting rail of the heater may be disposed along the opposing side wall at a second distance from the ceiling, where the first distance is greater than the second distance. The heater may be mounted on the first and second mounting rails, such that the planar heating interface forms the above-described oblique angle relative to the side wall having the air input openings.

Further, since the first mounting rail is disposed a greater distance from the ceiling than the second mounting rail, the first mounting rail can be disposed along the side wall underneath the air input openings formed in the side wall, with the planar heating interface extending at an upwards, oblique angle toward the second mounting rail disposed on the opposing side wall. The airflows may be blown or induced through the air input openings in the side wall, over the angled, planar heating interface, through the heating elements, and into the hot air cavity of the heater housing, which is fluidly coupled to either a bottom discharge air output opening or a side discharge air output opening of the HVAC unit, depending on the embodiment. By configuring the heater for compatibility and efficient operation with both bottom and side discharge HVAC units, installation techniques may be simplified, and a part cost for producing compatible and efficient heaters for HVAC units may be reduced. These and other features are described in detail below with reference to the drawings.

Further, the discussion below describes embodiments in accordance with the present techniques in the context of rooftop units (RTUs) having bottom and/or side discharge configurations, electric heaters, and electric heater housings. However, it should be appreciated that the disclosed techniques may be utilized with other types of HVAC units, such as air handling units, and other types of heaters.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, airflow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an airflow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an airflow is passed to condition the airflow before the airflow is supplied to the building. In the illustrated embodiment, the HVAC unit 12 is a rooftop unit (RTU) that conditions a supply air stream, such as environmental air and/or a return airflow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
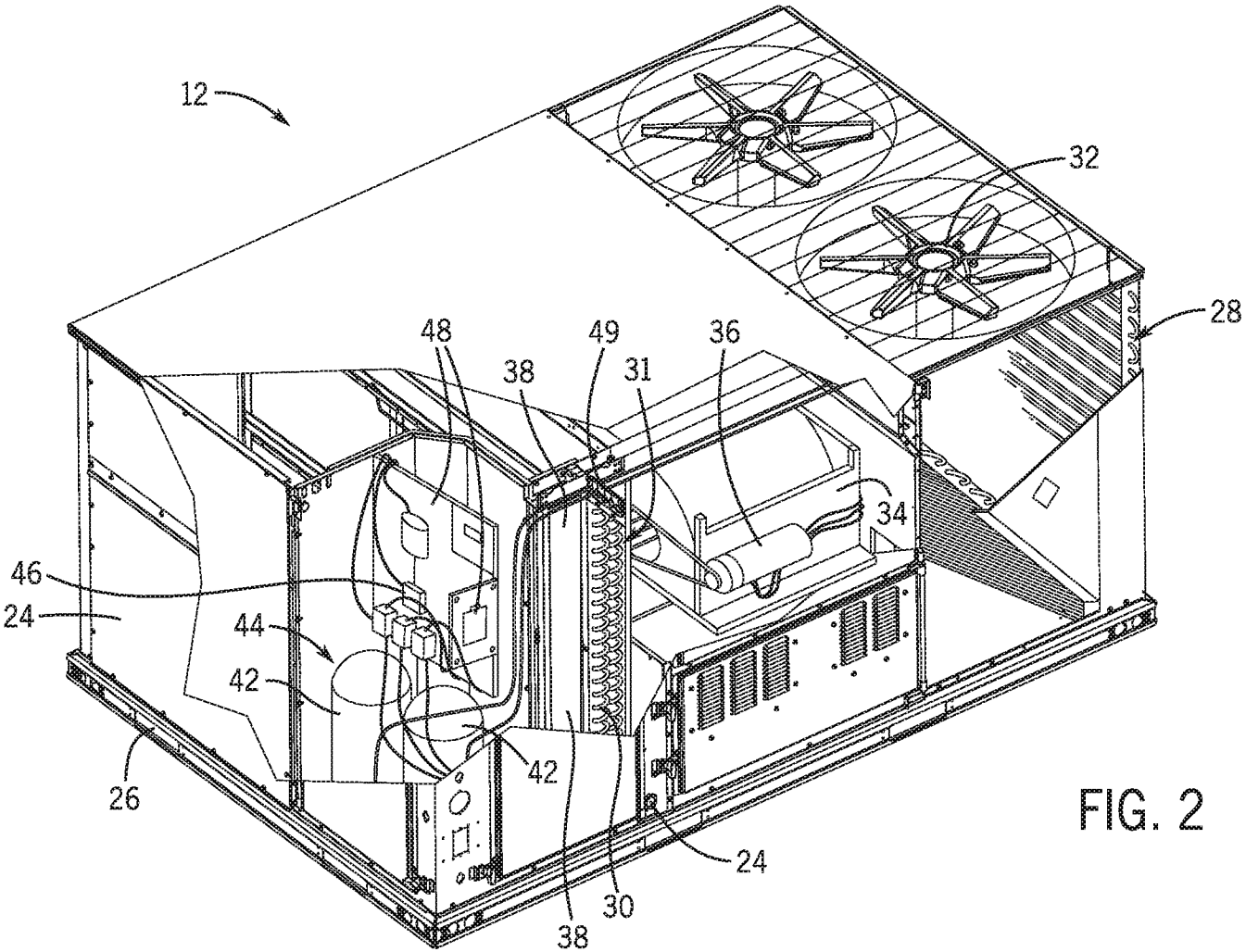
FIG. 2 is a perspective view of an embodiment of an HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation, or other various types of insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the airflows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
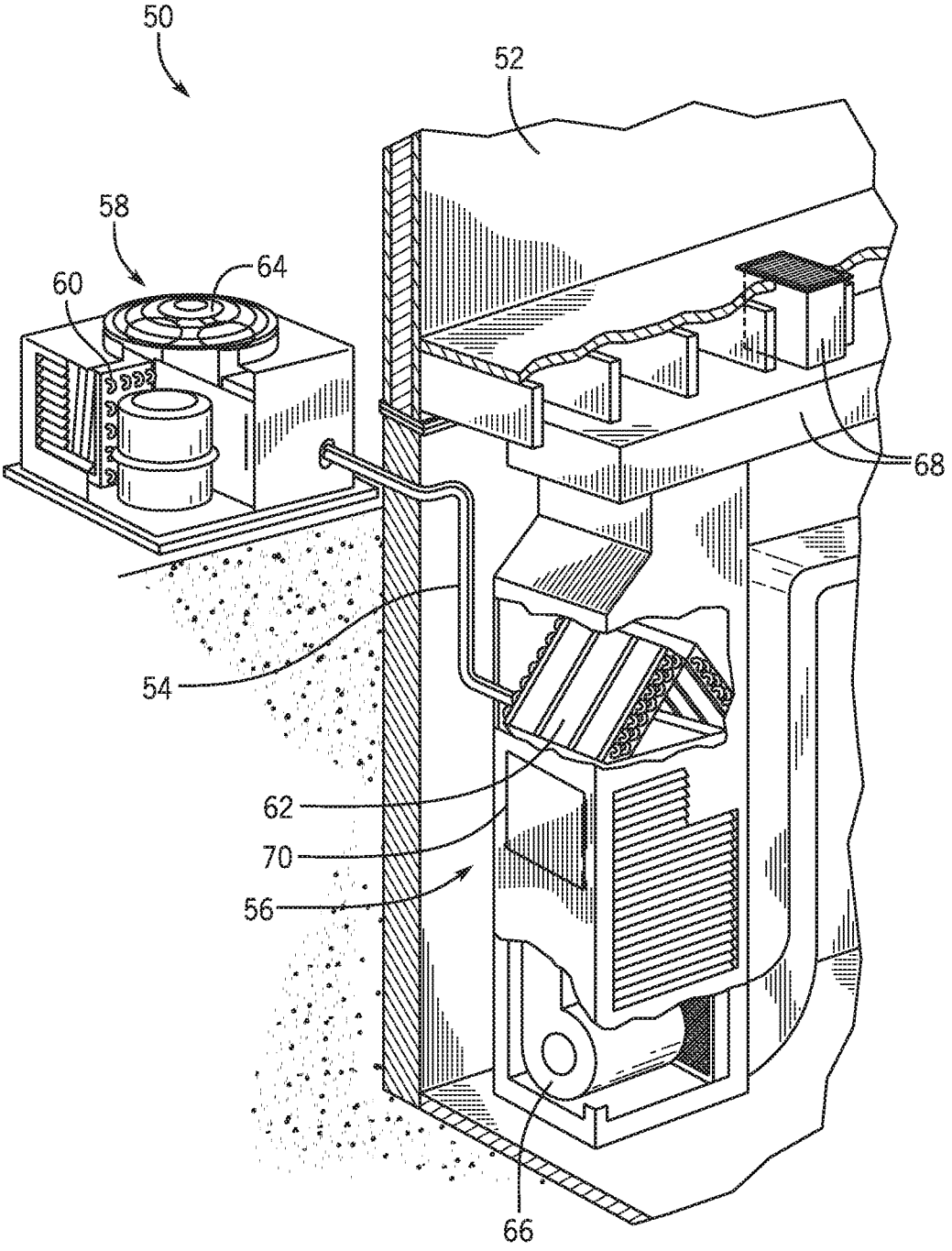
FIG. 3 is a cutaway, perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
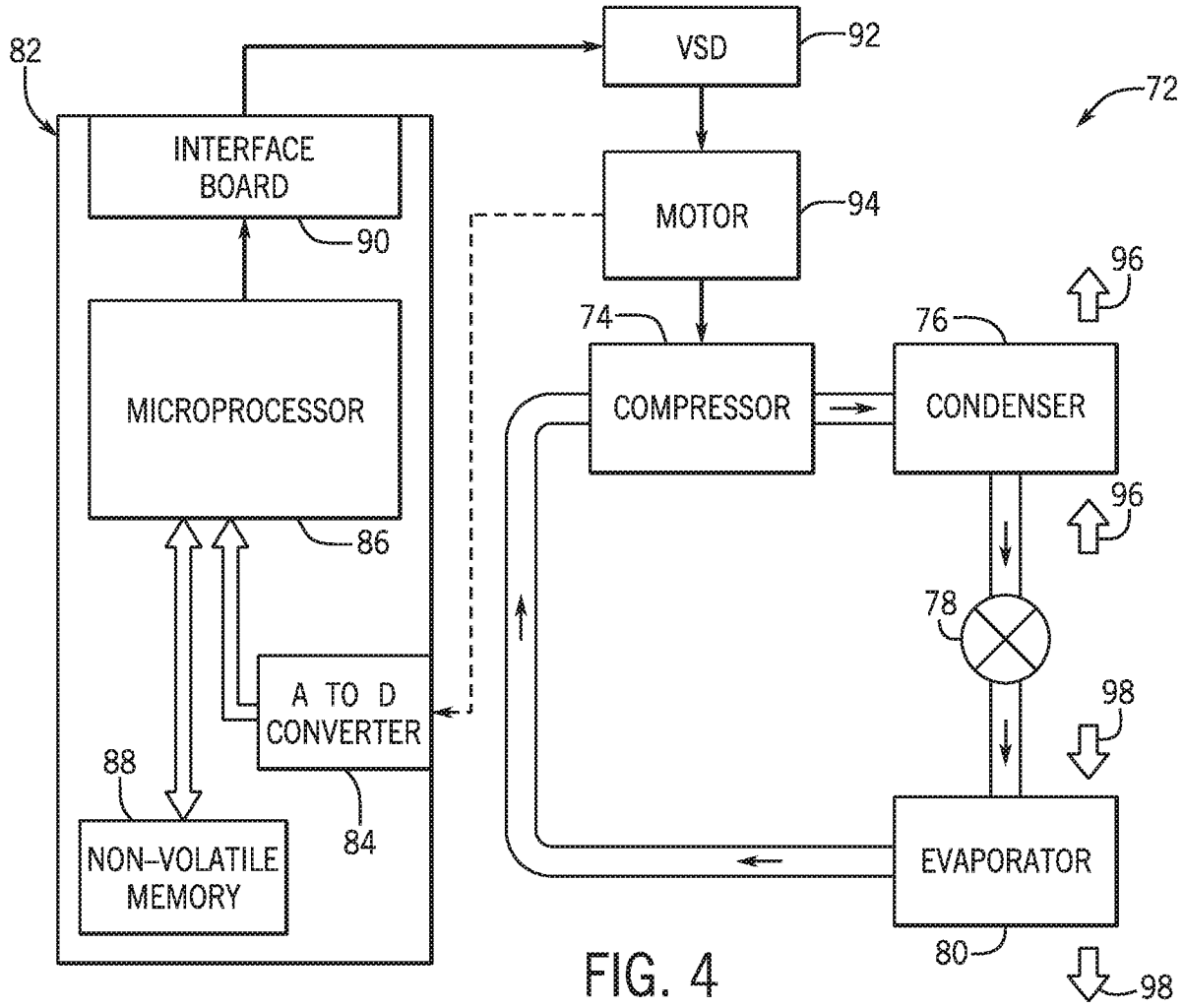
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed toward a heater, such as an electric heater, configured for use in both a bottom discharge HVAC unit and a side discharge HVAC unit. That is, the heater can be installed in, and efficiently operated with, an HVAC unit configured for bottom discharge and an HVAC unit configured for side discharge. In doing so, manufacturing, installation, and part cost may be reduced, and installation techniques may be simplified. Aspects of the heater that enable the described compatibility effects and efficient operation include an angle of heating surfaces, such as electric heating elements, employed by the heater, mounting rail features of the heater, airflow partitions of the heater, a midsection or divider between heating surfaces of the heater, and other aspects described in detail below.

Figure 5:
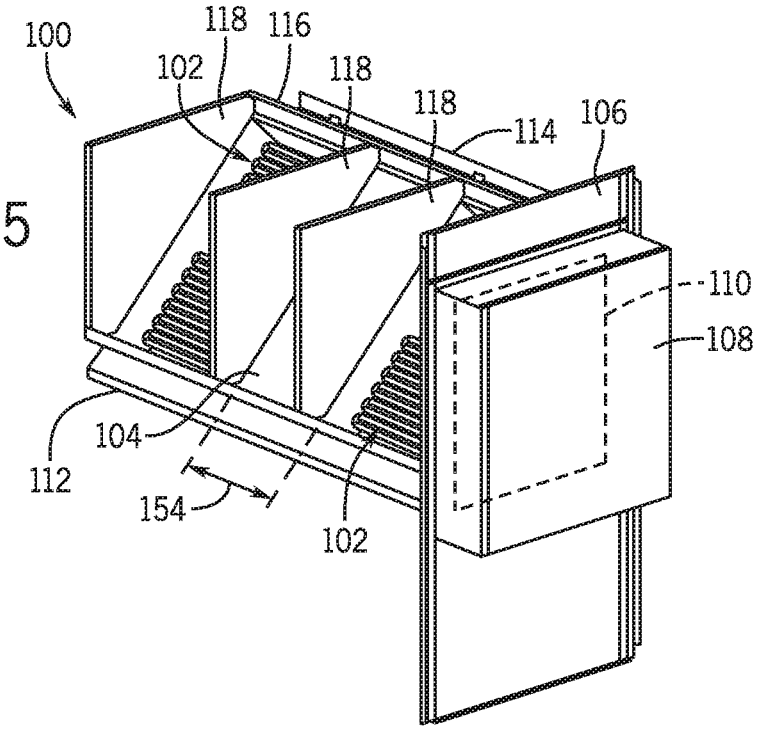
FIG. 5 is a perspective view of a heater for use in a rooftop unit (RTU) of the HVAC system of FIG. 1, in accordance with an aspect of the present disclosure.
Figure 6:
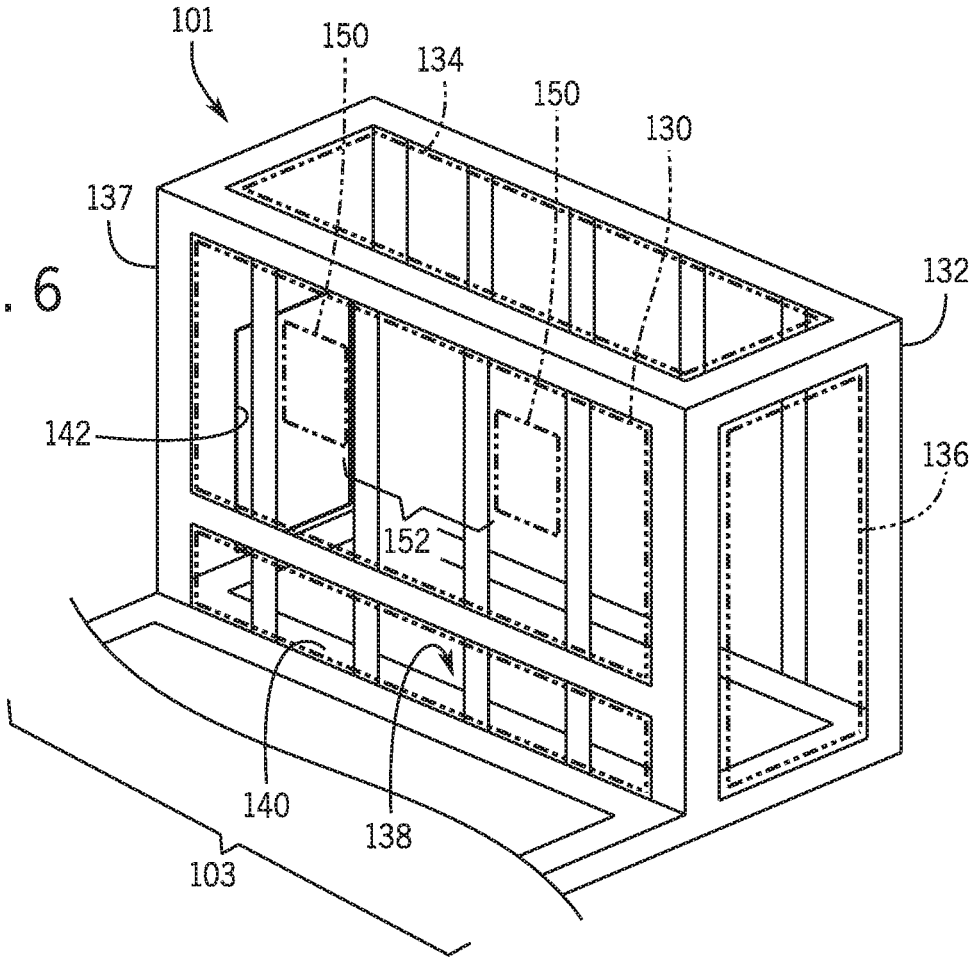
FIG. 6 is a perspective view of a heater housing of an RTU, in accordance with an aspect of the present disclosure.

FIG. 5 is a perspective view of an embodiment of an electric heater 100 for use in a rooftop unit (RTU) of an HVAC system, such as the HVAC unit 12 illustrated in FIG. 1. FIG. 6 is a perspective view of an embodiment of an electric heater housing 101 of an RTU 103, where the electric heater housing 101 of FIG. 6 is configured to receive the electric heater 100 of FIG. 5. It should be noted that structural and housing features of other aspects of the RTU 103 are removed from FIG. 6 to facilitate illustration and corresponding discussion of the disclosed aspects of the electric heater 100 and the electric heater housing 101.

In FIG. 5, the electric heater 100 includes two heating elements 102, a midsection 104 or coil divider between the two heating elements 102, a divider wall 106, a control box 108, a cut-out 110 in the divider wall 106 configured to enable electric coupling between control and/or power circuitry in the control box 108 and the two heating elements 102, a lower mounting rail 112, an upper mounting rail 114, an air block-off seal 116, and airflow partitions 118. The electric heater housing 101 of FIG. 6 includes a side wall 130, which is illustrated as translucent, an opposing side wall 132, and a ceiling 134 extending between the side wall 130 and the opposing side wall 132. The electric heater housing 101 in the illustrated embodiment also includes an end wall 136 and an opposing end wall 137. For purposes of discussion, the illustrated electric heater housing 101 includes a bottom discharge air output opening 138 formed in a bottom wall 140 of the electric heater housing 101, and a side discharge air output opening 142 formed in the opposing end wall 137 of the electric heater housing 101. However, in certain embodiments, the electric heater housing 101 of the RTU 103 may generally include only one of the bottom discharge air output opening 138 or the side discharge air output opening 142. It should be noted that end walls 136, 137 may be referred to as side walls in portions of the present disclosure. That is, the side wall 130, the opposing side wall 132, the end wall 136, and the opposing end wall 137 may be referred to as four side walls of the electric heater housing 101.

In FIG. 6, the side wall 130 of the electric heater housing 101 includes airflow inlets 150 corresponding to the heating elements 102 of the electric heater 100 illustrated in FIG. 5. That is, the airflow inlets 150 may correspond in number to the heating elements 102. A distance 152, or gap, between the airflow inlets 150 in FIG. 6 may correspond in length to a distance 154 between adjacent partitions 118 of the electric heater 100 in FIG. 5 (or a width of the midsection 104). The middle partitions 118 in FIG. 5 may be configured to contact the side wall 130 of the electric heater housing 101 in FIG. 6 to contain and direct airflows received through the airflow inlets 150, which will be described in detail in later embodiments. That is, the middle partitions 118 in FIG. 5 may guide the airflows received from the two airflow inlets 150 in FIG. 6 toward the respective heating elements 102 and away from the midsection 104 in FIG. 5. The outer partition 118 in FIG. 5 may also contain the airflow from passing around an edge of adjacent outer heating element 102.

Focusing on FIG. 5, the control box 108 may include control and/or power circuitry configured to control operation of the electric heating elements 102. For example, as described above, the cut-out 110 in the divider wall 106 of the electric heater 100 may facilitate an electric coupling between control and/or power circuitry in the control box 108 and the heating elements 102. The control and/or power circuitry may be utilized to control a heater setting of the heating elements 102 to enable controlled heating of the airflows directed thereacross. For example, each heating element 102 may include multiple glass-enveloped wires or wire coils, where the wires or wire coils are electrically coupled to, and controlled by, the control and/or power circuitry of the control box 108. The control and/or power circuitry of the control box 108 may control, for example, a temperature setting of the heating elements 102. Although the middle partitions 118 of the electric heater 100 are configured to guide airflows away from the midsection 104, as previously described, the midsection 104 may include a thermally conductive material, such as steel, which may improve operational efficiency of the heating elements 102.

The lower mounting rail 112 and the upper mounting rail 114 of the electric heater 100 in FIG. 5 are configured to be mounted to the side wall 130 and the opposing side wall 132, respectively, of the electric heater housing 101 in FIG. 6. The lower mounting rail 112 and the upper mounting rail 114 may be coupled to the side wall 130 and the opposing side wall 132, respectively, at different distances from the ceiling 134 of the electric heater housing 101, which enables an angled orientation of the heating elements 102 relative, for example, to the side wall 130. These and other features will be described in detail below with reference to later drawings. It should also be noted that the lower mounting rail 112 and the upper mounting rail 114 may be coupled to the side wall 130 and the opposing side wall 132, respectively, of the electric heater housing 101 prior to insertion of the heating elements 102, the divider wall 106, and/or the control box 108 into the electric heater housing 101. For example, the lower mounting rail 112 and the upper mounting rail 114 may be installed in the electric heater housing 101 and may include flanges, grooves, or other features configured to enable a sliding engagement between the heating elements 102 and the lower and upper mounting rails 112, 114. That is, the mounting rails 112, 114 may form tracks and the heating elements 102 and the midsection 104, which may cooperatively form a common assembly, may be slid into engagement with the mounting rails 112, 114. In some embodiments, the air block-off seal 116 may interface with the heating elements 102 and/or the midsection 104 and may operate to guide an airflow through the heating elements 102, as opposed to over edges of the electric heater 100 whereby the airflow bypasses the heating elements 102. The air block-off seal 116 may be a part of the upper mounting rail 114 or may be separate from the upper mounting rail 114. In certain embodiments, the air block-off seal 116 may slidingly engage with the upper mounting rail 114, similar to the heating elements 102 and/or midsection 104. The illustrated partitions 118 may also be coupled to features of the electric heater housing 101 and/or may be installed in the electric heater housing 101 prior to installation of the heating elements 102 and the midsection 104.

Figure 7:
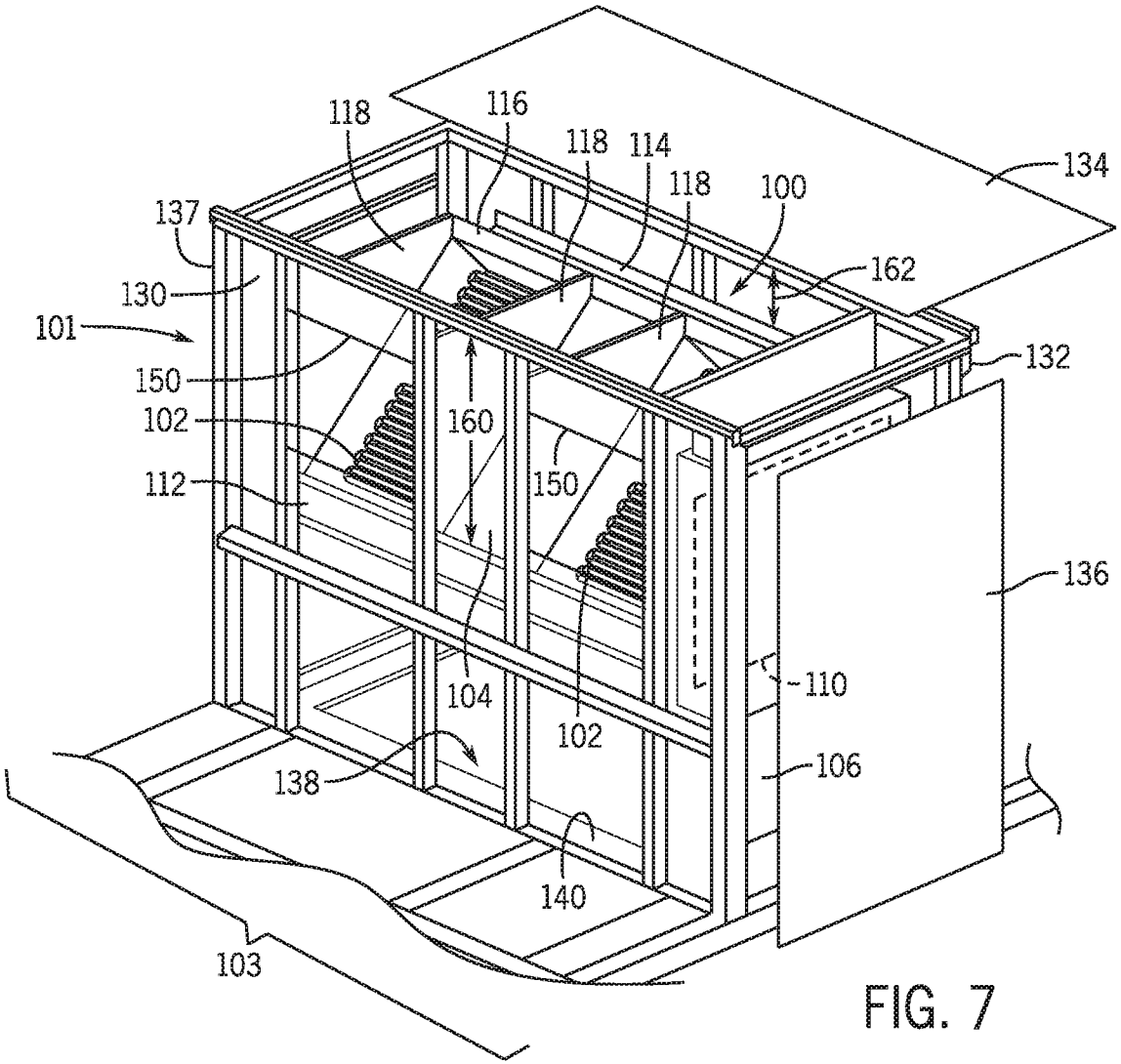
FIG. 7 is a perspective view of a portion of an RTU having the heater of FIG. 5 disposed in the heater housing of FIG. 6, in accordance with an aspect of the present disclosure.
Figure 8:
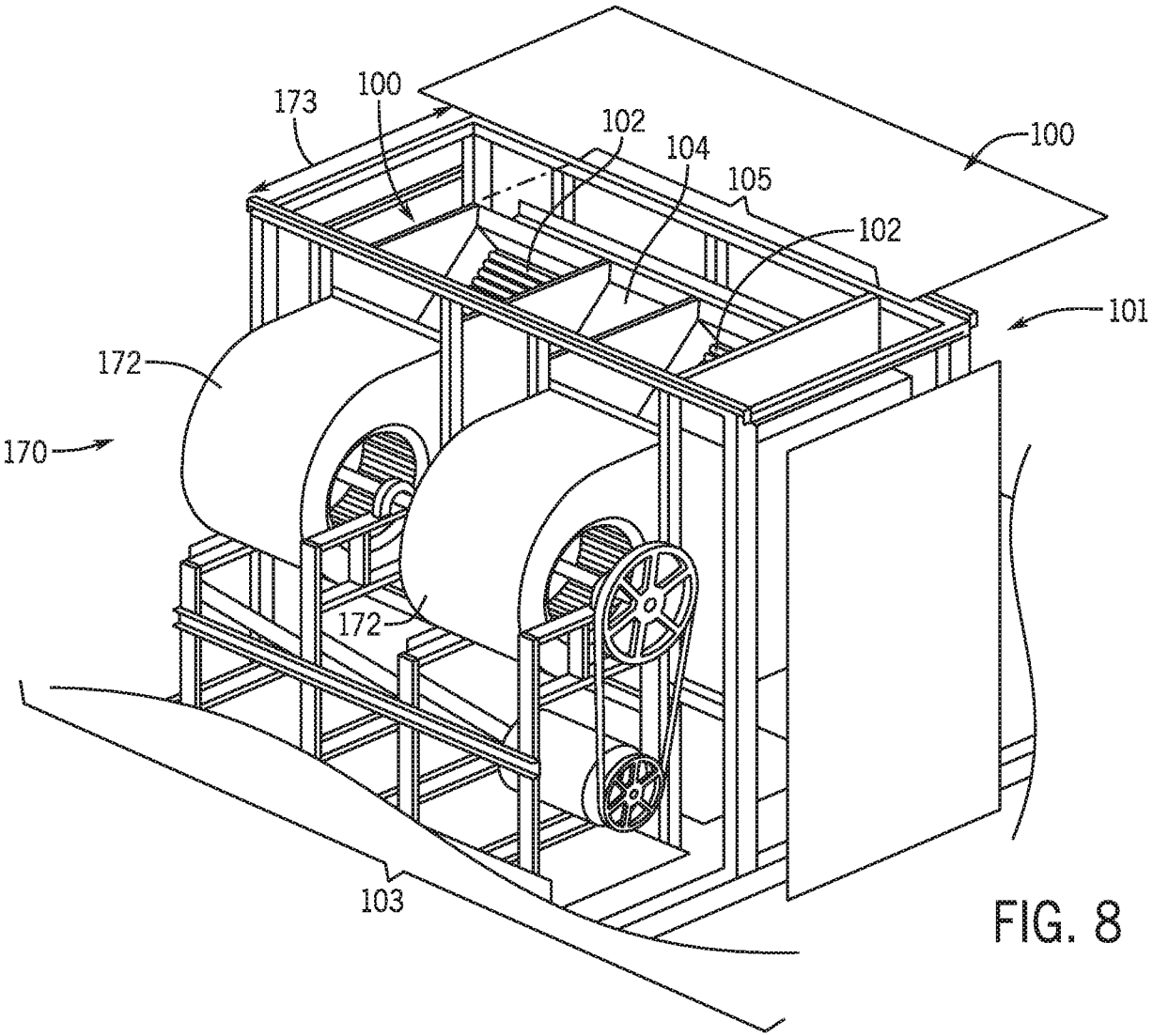
FIG. 8 is a perspective view of the portion of the RTU of FIG. 7 and a blower assembly, in accordance with an aspect of the present disclosure.

FIG. 7 is a perspective view of an embodiment of a portion of the RTU 103 having the electric heater 100 of FIG. 5 disposed in the electric heater housing 101 of FIG. 6. In FIGS. 7 and 8, the ceiling 134 and the end wall 136 are separated from the electric heater housing 101 to facilitate viewing of components of the RTU 103. With respect to FIG. 7, as previously described, the airflow inlets 150 may align with the heating elements 102 of the electric heater 100 along a direction of airflow travel. Thus, airflows received by the airflow inlets 150 are directed toward the heating elements 102 of the electric heater 100. The partitions 118 may also direct the airflows toward the heating elements 102 and away from the midsection 104 and/or edges of the electric heater 100.

The lower mounting rail 112 may be mounted to the side wall 130 of the electric heater housing 101 at a first distance 160 from the ceiling 134 of the electric heater housing 101, and the upper mounting rail 114 may be mounted to the opposing side wall 132 of the electric heater housing 101 at a second distance 162 from the ceiling 134 of the electric heater housing 101. The first distance 160 is greater than the second distance 162, in the illustrated embodiment. Accordingly, the heating elements 102, which extend between the lower and upper mounting rails 112, 114, are disposed at an oblique angle relative to the side wall 130 and the opposing side wall 132. For example, the heating elements 102 individually and/or collectively form a planar heating interface disposed at the oblique angle. The heating elements 102 are also disposed at an oblique angle relative to the airflows directed through the airflow inlets 150 in the side wall 130 of the electric heater housing 101. By angling the heating elements 102, a surface area of the heating elements 102 may be increased relative to embodiments having heaters arranged in a perpendicular or parallel configuration relative to the side wall 130. Further, the angled configuration of the heating elements 102 may enable a reduction in back pressure on the airflows and corresponding airflow biasing devices, such as blowers. FIG. 8 is a perspective view of an embodiment of the RTU 103 of FIG. 7 having a blower assembly 170 with two blowers 172 aligned with the airflow inlets 150 illustrated in FIG. 7. As shown in FIG. 8, the two heating elements 102 and the midsection 104 may be collectively referred to as a heating element assembly 105 of the electric heater 100. The angled configuration of the heating assembly 105 may facilitate an increased surface area of the heating element assembly 105 compared, for example, to an embodiment having a heater extending horizontally across a width 173 of the electric heater housing 101. Further, the angled configuration may reduce a back pressure of the airflows relative to traditional embodiments. The angled configuration may also facilitate use of the electric heater 100 in RTUs 103 having side discharge configurations and bottom discharge configurations.

Figure 9:
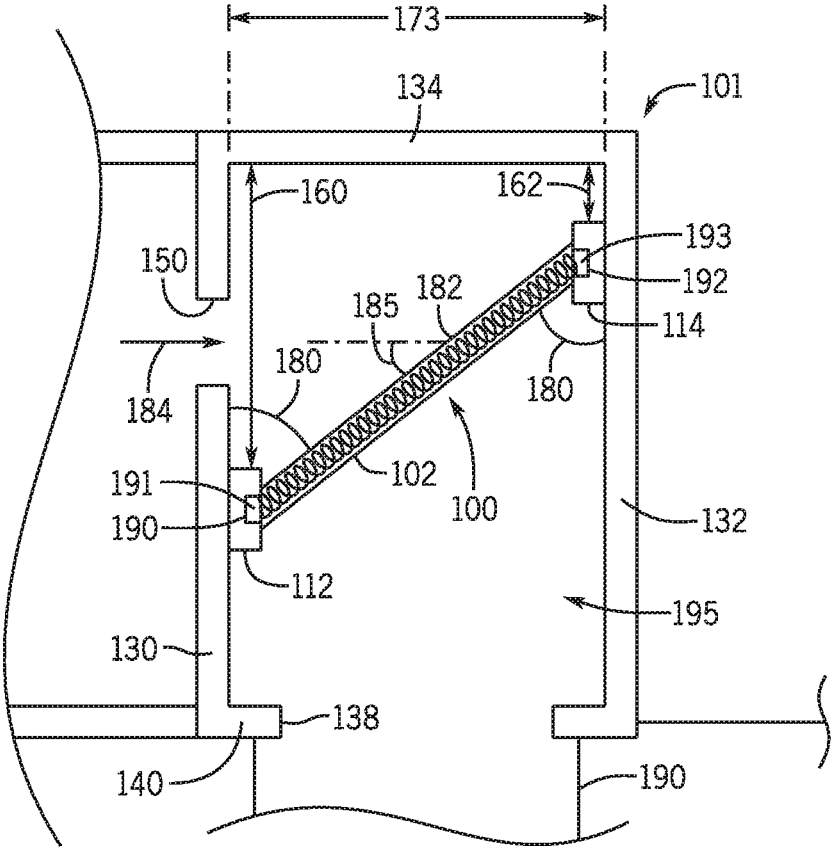
FIG. 9 is a cross-sectional, schematic side view of an interface between the heater of FIG. 5 and a side wall of the heater housing of FIG. 6.

To further illustrate the angled configuration of the heating element assembly 105, FIG. 9 is a cross-sectional, schematic side view of an embodiment of an interface between the electric heater 100 and the side wall 130 of the electric heater housing 101. In the illustrated embodiment, the electric heater housing 101 includes the side wall 130, the opposing side wall 132, the ceiling 134 extending between the side wall 130 and the opposing side wall 132, and the bottom wall 140 extending between the side wall 130 and the opposing side wall 132. The bottom discharge air output opening 138 is formed in the bottom wall 140, although the illustrated electric heater 100 features may also be incorporated an RTU and corresponding electric heater housing having the side discharge air output opening 142 discussed above. As shown, the lower mounting rail 112 of the electric heater 100 is mounted to the side wall 130 at the first distance 160 from the ceiling 134, and the upper mounting rail 114 is mounted to the opposing side wall 132 at the second distance 162 from the ceiling 134. The first distance 160 is greater than the second distance 162. Thus, the heating elements 102, which extend between and couple to the lower and upper mounting rails 112, 114, form an oblique angle 180 with both the side wall 130 and the opposing side wall 132. More particularly, in the illustrated embodiment, a planar heating interface 182 of the heating elements 102 forms the oblique angle 180 with the side wall 130 and the opposing side wall 132. In the illustrated embodiment, the lower mounting rail 112 includes a groove 190 which receives an extension 191 of the illustrated heating element 102, and the upper mounting rail 114 includes a groove 192 which receives an extension 193 of the heating element 102. The grooves 190, 192 and corresponding extensions 191, 193 may facilitate a sliding engagement between the mounting rails 112, 114 and the heating element 102 and, more generally, the heating element assembly 105 discussed with reference to FIG. 8, which is formed by the two heating elements 102 and the midsection 104. The sliding engagement may facilitate improved installation techniques and reduced cost.

It should be noted that the planar heating interface 182 may refer to an interface generally formed at least in part by, for example, glass-enveloped wires or wire coils electrically connected to the control box described with respect to previous drawings, where each heating element 102 may include several iterations of the glass-enveloped wires or wire coils forming the planar heating interface 182. That is, "planar heating interface" should be understood to refer to a plane extending across the two previously described heating elements 102 and the midsection 104, as opposed to necessarily referring to a single surface of a single heater component. For example, the heating element assembly 105 illustrated in FIG. 8, which includes the heating elements 102 and the midsection 104, may form the planar heating interface 182. The planar heating interface 182 may also form an angle 185 relative to a travel direction of incoming airflows 184. The oblique angle 180 discussed above may be, for example, within a range of 20 to 70 degrees relative to the side wall 130 and the opposing side wall 132. Likewise, the angle 185 may be, for example, within a range of 20 to 70 degrees relative to the airflows 184 entering the airflow inlets 150, noting that only one of the airflow inlets 150 is shown in the illustrated embodiment due to the cross-sectional view of FIG. 9.

Figure 10:
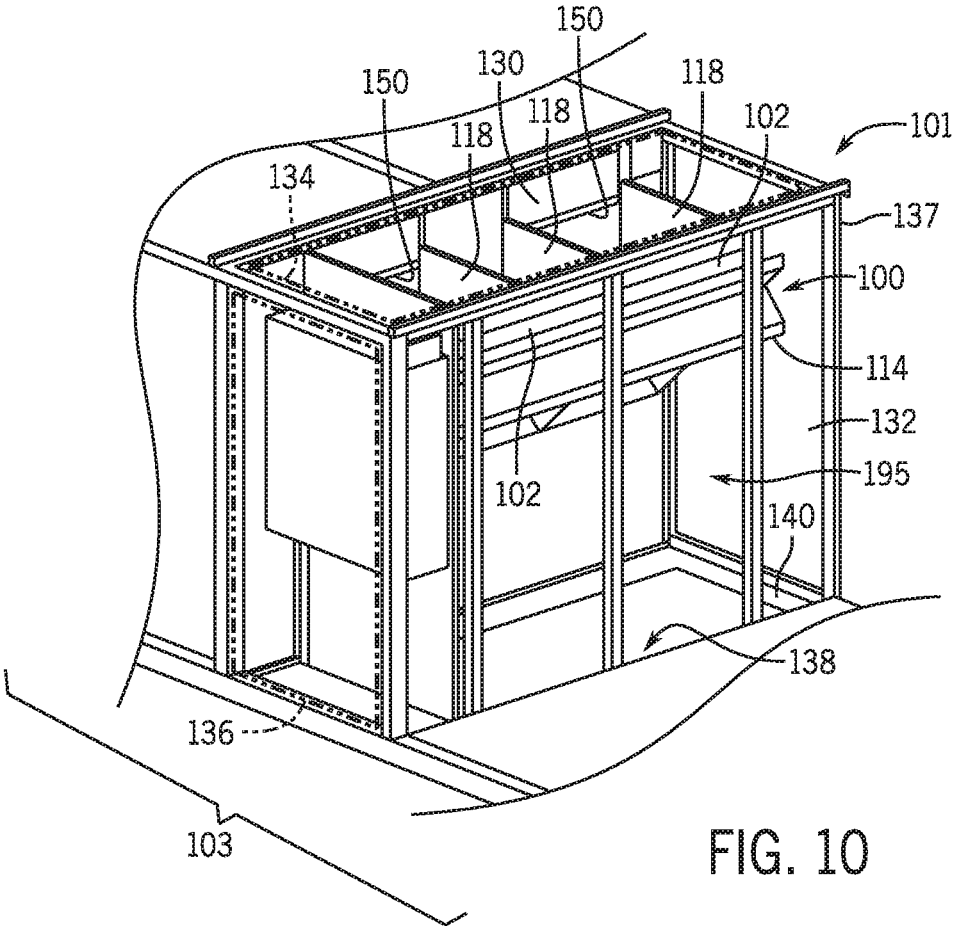
FIG. 10 is a rear perspective view of an RTU having the heater of FIG. 5, in accordance with an aspect of the present disclosure.

As the airflows 184 are passed over the heating elements 102, the airflows 184 may be directed downwardly into a hot air cavity 195 of the electric heater housing 101. In the illustrated embodiment, the hot air cavity 195 is fluidly coupled to the bottom discharge air output opening 138 formed in the bottom wall 140 of the electric heater housing 101. The bottom discharge air output opening 138 may be coupled to a duct 190, either directly or indirectly, such that the duct 190 can guide the heated air to a conditioned space. FIG. 10 is a rear perspective view of an embodiment of the RTU 103 for use in the HVAC system of FIG. 1, where the RTU 103 includes the electric heater 100 disposed in the electric heater housing 101 of the RTU 103. As shown, the electric heater housing 101 includes the hot air cavity 195 disposed underneath the electric heater 100, where the hot air cavity 195 is configured to receive the heated air and guide the heated air to the bottom discharge air output opening 138. It should be noted that, in another embodiment, the electric heater housing 101 of the RTU 103 may not include the illustrated bottom discharge air output opening 138 formed in the bottom wall 140 of the electric heater housing 101, but may instead include the side discharge air output opening 142 formed in the end wall 137 (or side wall) of the electric heater housing 101. As previously described, the partitions 118 of the electric heater 100 are coupled to the side wall 130 of the electric heater housing 101 in order to guide the airflows received from the airflow inlets 150 toward the heating elements 102.

As described above, and in accordance with the present disclosure, a heater, such as an electric heater, is configured for compatibility and efficient operation in both a bottom discharge RTU and a side discharge RTU. That is, the electric heater can be employed in both a bottom discharge and a side discharge RTU. For example, the electric heater may be configured to be installed at an angle within the RTU, and may include installation features, such as mounting rails, that enable the angled configuration. By configuring the electric heater for compatibility and efficient operation in both a side and bottom discharge RTU, a manufacturing and/or part cost may be reduced compared to traditional embodiments in which separate types of heaters are employed for separate types of RTUs. Further, an installation process may be simplified and a cost of installation may be reduced, compared to traditional embodiments.

While only certain features and embodiments of the disclosure have been illustrated and described, many modifications and changes may occur to those skilled in the art, such as variations in sizes, dimensions, structures, shapes and proportions of the various elements, values of parameters including temperatures and pressures, mounting rail arrangements, use of materials, colors, orientations, etc., without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A rooftop unit, comprising:

a heater housing having a first side wall, a second side wall opposing the first side wall, a ceiling extending between the first side wall and the second side wall, a bottom wall extending between the first side wall and the second side wall, and an end wall coupled to the first side wall, the second side wall, the ceiling, and the bottom wall;

a first mounting rail disposed across the first side wall at a first distance from the ceiling, and a second mounting rail disposed across the second side wall at a second distance from the ceiling, wherein the first distance is greater than the second distance;

a heating element assembly coupled to the first and second mounting rails and having a first heating element, a second heating element, and a midsection disposed between the first heating element and the second heating element, wherein the first heating element, the second heating element, and the midsection form a planar heating interface extending from the first mounting rail to the second mounting rail;

a first airflow inlet disposed in the first side wall of the heater housing at a first position between the first mounting rail and the ceiling, wherein the first airflow inlet is aligned with the first heating element of the heating element assembly;

a second airflow inlet disposed in the first side wall of the heater housing at a second position between the first mounting rail and the ceiling, wherein the second airflow inlet is aligned with the second heating element of the heating element assembly; and a side discharge airflow outlet disposed in the end wall.

2. The rooftop unit of claim 1, wherein the first heating element comprises a first electric heating element, and the second heating element comprises a second electric heating element.

3. The rooftop unit of claim 2, wherein the first electric heating element comprises a first glass-enveloped wire or wire coil, and the second electric heating element comprises a second glass-enveloped wire or wire coil.

4. The rooftop unit of claim 1, comprising:

a first fan or blower disposed adjacent an outer surface of the first side wall opposing an inner surface of the first side wall on which the first mounting rail is disposed, wherein the first fan or blower is configured to direct a first airflow through the first airflow inlet and toward the first heating element of the heating element assembly; and a second fan or blower disposed adjacent the outer surface of the first side wall opposing the inner surface of the first side wall on which the first mounting rail is disposed, wherein the second fan or blower is configured to direct a second airflow through the second airflow inlet and toward the second heating element of the heating element assembly.

5. The rooftop unit of claim 1, wherein the heater housing includes a bottom discharge airflow outlet formed in the bottom wall.

6. The rooftop unit of claim 1, comprising a divider wall coupled to the heating element assembly and disposed within the heater housing.

7. The rooftop unit of claim 6, wherein the heating element assembly extends from a first surface of the divider wall, a control box extends from a second surface of the divider wall opposing the first surface of the divider wall, and the control box is electrically coupled to the heating element assembly through a divider wall cut-out.

8. The rooftop unit of claim 7, wherein the heater housing includes an additional end wall disposed adjacent to the divider wall and extending between the first side wall and the second side wall, and the control box is disposed between the divider wall and the additional end wall of the heater housing.

9. The rooftop unit of claim 1, wherein the heating element assembly is configured to slidingly engage with the first mounting rail and the second mounting rail.

10. The rooftop unit of claim 1, comprising a partition coupled to the first side wall, to the ceiling, or both, wherein the partition is disposed between the first heating element and the second heating element.

11. The rooftop unit of claim 10, comprising an additional partition disposed between the first heating element and the second heating element, wherein the partition is positioned adjacent to a first side of the midsection of the heating element assembly and the additional partition is positioned adjacent to a second side of the midsection of the heating element assembly opposing the first side.

12. The rooftop unit of claim 1, wherein the planar heating interface forms an angle relative to the first side wall, and wherein the angle is between 20 and 70 degrees.

13. A rooftop unit, comprising:

an electric heater housing having a side wall, an opposing side wall, and a ceiling extending between the side wall and the opposing side wall;

an electric heater disposed in the electric heater housing and having a first portion of a planar heating interface formed by a first heating element of the electric heater and a second portion of the planar heating interface formed by a second heating element of the electric heater, wherein the planar heating interface extends from a first mounting rail disposed on the side wall and to a second mounting rail disposed on the opposing side wall, and wherein the planar heating interface forms an oblique angle relative to the side wall;

a midsection disposed between the first heating element of the electric heater and the second heating element of the electric heater;

a first partition extending from the electric heater at a first location between the first heating element and the midsection, wherein the first partition is coupled to the side wall, the opposing side wall, and the ceiling;

a second partition extending from the electric heater at a second location between the second heating element and the midsection, wherein the second partition is coupled to the side wall, the opposing side wall, and the ceiling;

a first airflow inlet disposed in the side wall of the electric heater housing at a first position between the first mounting rail and the ceiling, wherein the first airflow inlet is aligned with the first heating element of the electrical heater; and a second airflow inlet disposed in the side wall of the electric heater housing at a second position between the first mounting rail and the ceiling, wherein the second airflow inlet is aligned with the second heating element of the electric heater.

14. The rooftop unit of claim 13, wherein:

the first mounting rail is disposed on the side wall at a first distance from the ceiling; and the second mounting rail is disposed on the opposing side wall at a second distance from the ceiling, the first distance is greater than the second distance, and the first heating element and the second heating element are coupled to the first mounting rail and the second mounting rail.

15. The rooftop unit of claim 13, comprising:

a first blower positioned external to the electric heater housing, aligned with the first airflow inlet and configured to force a first airflow through the first airflow inlet, over and through the first heating element, and into a hot air cavity of the electric heater housing, wherein the hot air cavity is fluidly coupled to either a bottom discharge airflow outlet formed in a bottom wall of the electric heater housing or a side discharge airflow outlet formed in an end wall of the electric heater housing; and a second blower position external to the electric heater housing, aligned with the second airflow inlet and configured to force a second airflow through the second airflow inlet, over and through the second heating element, and into the hot air cavity.

16. The rooftop unit of claim 13, comprising:

a bottom wall of the electric heater housing, wherein the bottom wall opposes the ceiling and is coupled to the side wall and the opposing side wall; and a bottom discharge airflow outlet disposed in the bottom wall.

17. The rooftop unit of claim 13, comprising:

an end wall of the electric heater housing, wherein the end wall is coupled to the side wall, the opposing side wall, and the ceiling; and a side discharge airflow outlet disposed in the end wall.

18. An electric heater, comprising:

an electric heater housing having a first side wall, a second side wall opposing the first side wall, and a ceiling;

a first mounting rail configured to be mounted on the first side wall at a first position that is at a first distance from the ceiling;

a second mounting rail configured to be mounted on the second side wall at a second position that is at a second distance from the ceiling, wherein the first distance is greater than the second distance;

a heating element assembly configured to be coupled to the first mounting rail and the second mounting rail and having a first heating element, a second heating element, and a midsection between the first heating element and the second heating element, wherein the first heating element, the second heating element, and the midsection form a planar heating interface configured to form an oblique angle with the first side wall and the second side wall;

a first airflow inlet disposed in the first side wall between the first mounting rail and the ceiling, wherein the first airflow inlet is aligned with the first heating element; and a second airflow inlet disposed in the side wall between the first mounting rail and the ceiling, wherein the second airflow inlet is aligned with the second heating element.

19. The electric heater of claim 18, wherein the electric heater comprises:

a bottom wall that opposes the ceiling and extends between the first side wall and the second side wall;

a bottom discharge airflow outlet disposed in the bottom wall;

an end wall that is coupled to the ceiling, the first side wall, the second side wall, and the bottom wall; and a side discharge airflow outlet disposed in the end wall.

20. The electric heater of claim 18, wherein the electric heater comprises:

a first partition coupled to the first side wall, the second side wall, and the ceiling, wherein the first partition is configured to extend between the first heating element and the midsection; and a second partition coupled to the first side wall, the second side wall, and the ceiling, wherein the second partition is configured to extend between the second heating element and the midsection.

21. The electric heater of claim 18, comprising:

a first fan or blower aligned with the first airflow inlet, wherein the first fan or blower is configured to direct a first airflow through the first airflow inlet; and a second fan or blower aligned with the second airflow inlet, wherein the second fan or blower is configured to direct a second airflow through the second airflow inlet.

22. The electric heater of claim 18, comprising:

the ceiling of the electric heater housing, wherein the ceiling is coupled to the first side wall and the second side wall;

a bottom wall of the electric heater housing, wherein the bottom wall opposes the ceiling and is coupled to the first side wall and the second side wall; and a bottom discharge airflow outlet disposed in the bottom wall.

23. The electric heater of claim 18, comprising:

the ceiling of the electric heater housing, wherein the ceiling is coupled to the first side wall and the second side wall;

a bottom wall of the electric heater housing, wherein the bottom wall opposes the ceiling and is coupled to the first side wall and the second side wall;

an end wall of the electric heater housing, wherein the end wall is coupled to the first side wall, the second side wall, the bottom wall, and the ceiling; and a side discharge airflow outlet disposed in the end wall.

24. The electric heater of claim 18, wherein the planar heating interface is configured to form the oblique angle with the first side wall such that the oblique angle is between 20 degrees and 70 degrees.

* * * * *